US008359800B2

(12) United States Patent
Marocco

(10) Patent No.: US 8,359,800 B2
(45) Date of Patent: Jan. 29, 2013

(54) SHUTTER BORDER FRAME WITH CHANNEL AND COVER PLUG

(76) Inventor: Mario M Marocco, Toronto (CA)

( * ) Notice: Subject to any disclaimer, the term of this patent is extended or adjusted under 35 U.S.C. 154(b) by 438 days.

(21) Appl. No.: 12/656,792

(22) Filed: Feb. 17, 2010

(65) Prior Publication Data

US 2011/0197539 A1 Aug. 18, 2011

(51) Int. Cl.
*E04B 7/08* (2006.01)
*E04C 2/38* (2006.01)
*E06B 7/08* (2006.01)

(52) U.S. Cl. ..... 52/473; 52/656.4; 52/656.5; 52/656.7; 49/92.1

(58) Field of Classification Search ..... 52/473, 52/211, 302.1, 656.7, 656.1, 656.2, 656.4, 52/656.5, 656.8, 656.9; 49/74.1, 77.1, 79.1, 49/92.1; 454/277; 160/374.1, 381
See application file for complete search history.

(56) References Cited

U.S. PATENT DOCUMENTS

| | | | | |
|---|---|---|---|---|
| 6,050,037 | A * | 4/2000 | Gifford | 52/211 |
| 6,474,038 | B2 | 11/2002 | Nien | |
| 6,807,783 | B2 * | 10/2004 | Lee | 52/473 |
| 7,941,982 | B2 * | 5/2011 | Merica | 52/235 |
| 2002/0121067 | A1 * | 9/2002 | Nien et al. | 52/717.01 |
| 2007/0022699 | A1 * | 2/2007 | Wang | 52/656.4 |
| 2007/0175123 | A1 * | 8/2007 | Bernier et al. | 52/211 |

* cited by examiner

*Primary Examiner* — William Gilbert

(57) ABSTRACT

A shutter assembly having a shutter with louvres, and a border frame for surrounding the shutter which is attachable to a building and having a plurality of frame side sections each formed of sections of extruded plastic, a plurality of hollow tubes, separated by thin walls, defined in the sections, a fastener channel formed integrally in the frame side sections for receiving fasteners for holding the shutter assembly in place, and, an extruded plastic removable cover plug channel having flexible side walls for fitting in the fastener channel and closing the channel and thereby concealing heads of the fasteners.

15 Claims, 3 Drawing Sheets

SHUTTER BORDER FRAME WITH CHANNEL AND COVER PLUG

FIELD OF THE INVENTION

The present invention relates to the field of shutters for windows and doorways. More particularly, the present invention relates to a shutter assembly with a border frame in which the border frame is a plastic extrusion with a fastener channel for fasteners and an extruded plastic cover channel that can conceal heads of fasteners in the fastener channel.

BACKGROUND OF THE INVENTION

A shutter assembly typically comprises a frame and a plurality of vertically spaced horizontal louvres. The louvres are rotatably adjustable to tilt to and fro to exclude light or to admit light.

Generally, such shutter assemblies have a rectangular frame comprised of vertically and horizontally spaced side portions. The frame is mounted around a doorway window or opening, and is securely held in place by fasteners, passing through the shutter frame. The shutter is mounted in the frame.

In many cases it is desirable to provide such a border frame with an aesthetic shape or design. The actual shutter can be placed within the border frame, and the combination provides a pleasing appearance. Methods are known to conceal the fasteners, including counter-sinking, insertion of putty or synthetic wood over the head of a fastener, and final finishing by sanding, paint or other material. All these methods have significant disadvantages because they require expensive tools, carpentry expertise and time to apply them. In the past shutters were usually made of wood for simplicity and for aesthetics.

Materials such as plastics, especially extruded plastics, have many advantages over wood. However fabrication techniques in plastics have not kept pace with the consumer demand to decorate homes and offices with shutters.

Consumers require plastic shutters having an appearance similar to wooden shutters. Fabricating shutters and the border frames from plastic components, which simulate wood can be a challenge.

Wooden shutters and wooden frames are shaped with a solid comfortable appearance, and define substantial thickness and attractive contours and shapes.

Wooden shutter frames may be milled out of a solid piece of wood. Thus the profile of the frame may be given a variety of shapes, for decorative effect.

Achieving this look with plastic components is not as simple as it may appear.

The plastic border frame should preferably have contouring comparable to the contours of a wooden window or door frame.

Plastic shutters are usually made with frames which are of plain rectangular cross section. In order to provide a border frame with the same decorative effect as a milled wooden frame, it is desirable to fabricate a separate border frame, into which the actual shutter can be seated and secured.

Making such border framing out of extruded plastic, requires great care. Plastics generally are unsuitable for creating solid shapes. Some plastics are exceptions to this but for so called thermoplastics it is necessary that they be formed with sections which are thin and cool easily without distortion. Economy of material is another reason for this.

When fabricating sections such as border frames for shutters, out of plastic, it is desirable to form such sections by extrusion. Lengths of sections can be made in this way. The sections can then be cut to length to fabricate the four sides of the frame of a particular shutter. In addition the border frame must be fastened to the building fabric, around the window by fasteners.

For aesthetic reasons, it is desirable to conceal heads of the fasteners after the installation.

Such extrusions are designed with a series of hollow channels or tubes, defined by a number of walls extending through the section. The actual thickness of any wall is relatively thin. Extruding such sections with a large number of hollow tubes is itself a challenge. The dies must be designed to allow the plastic to be extruded while hot, and flowable. After extrusion, the chilling of the extruded section must be achieved in such a way as to maintain, as far as possible, the integrity of the entire design.

To achieve all this the section of the extrusion must be designed to facilitate this, while at the same time producing a pleasing aesthetic appearance, on the exterior.

Added to all these considerations there is a need for a shutter assembly designed for manufacture from thermoplastic material having a border frame that includes a recess or fastener channel to receive fasteners. Preferably a removable extruded plastic plug in the form of an inverted three sided channel, is provided to cover the fasteners without the requirement for tools and carpentry expertise.

Such border frame sections must also be capable of being securely joined at the four corners, so as to form a rigid four sided border frame. The extrusion must therefor be designed in such a way that it can accommodate corner junctions and reinforcements.

This need may be addressed by forming the border frame section for the border frame with a recessed fastener channel for fasteners and a cover plug channel that is inverted and fitted into the fastener channel to cover the heads of the fasteners.

In U.S. Letters Pat. No. 6,474,038, Window Shutter Frame Assembly and Method of Installation, there is shown a frame with a basic form of fastener concealment system, but it is designed for wooden shutters with solid components.

This type of system was restricted to shutters having wooden frames. The wooden frames have a channel for the fasteners, and a solid wooden bead is shaped for insertion into the channel.

This wooden system lacks flexibility and is not adaptable to use with shutter frames formed of extruded plastic material. It is also incapable of receiving corner junctions for extra strength. This may reduce its working life.

In addition to these considerations, there is also a problem with the actual depth of a particular shutter. Shutters having wider louvres will have a rectangular frame which is relatively deep. Shutters having louvres which are of lesser width will have a frame which is less deep.

Preferably the border frame may be adaptable to provide greater or lesser depth. It is therefor desirable to provide extension members, similar to "shims" which can be added to the border frame to give it increased depth.

BRIEF SUMMARY OF THE INVENTION

The present invention comprises a shutter assembly with a border frame in which the border frame is formed of border frame sections of extruded plastic material, and has a plurality of hollow tubes, separated by thin walls, formed in said border frame section, and has a fastener channel formed integrally in the border frame section for receiving fasteners to hold the border frame assembly in place, and a removable cover plug channel for interfitting with the fastener channel so as to conceal heads of the fasteners.

Preferably, each border frame section of the border frame has a plurality of inner channels and tubular portions, providing a reinforced hollow interior.

Usefully, vertical and horizontal side sections of the border frame are connected at each corner by at least two L-shaped reinforcement junction brackets.

Preferably the border frame sections are formed with connection ribs for receiving the junction brackets.

Preferably, each fastener channel of the border frame section is comprised of at least two channel walls and a bottom surface and having a locking rib that extends along the axis of the channel walls from one end of the inner channel of the other.

Usefully, the cover plug is formed of extruded plastic material and defines a three sided channel, consisting of a cover wall and two plug walls, formed integrally of thermoplastic material.

Preferably, the plug walls of the cover plug are resilient and flexible to assist in insertion into the fastener channel and make a friction fit Preferably, each of the plug walls of the cover plug has an inner and outer side and a groove that extends along the axis of the side wall from one end of the outer side of the side wall to the other to receive respective locking ribs.

Preferably there are foot members attachable to the border frame sections, in order to provide a border frame of greater depth, when required.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

A shutter assembly (10) shown in FIG. (1), illustrating an embodiment of invention, is shown installed in registration with a window (or a door) (W). In the context of this description, although the description which follows discloses the shutter as installed in a window (W), it should be understood that the shutter assembly (10) with minor modifications can be installed in a doorway.

Figure 1:
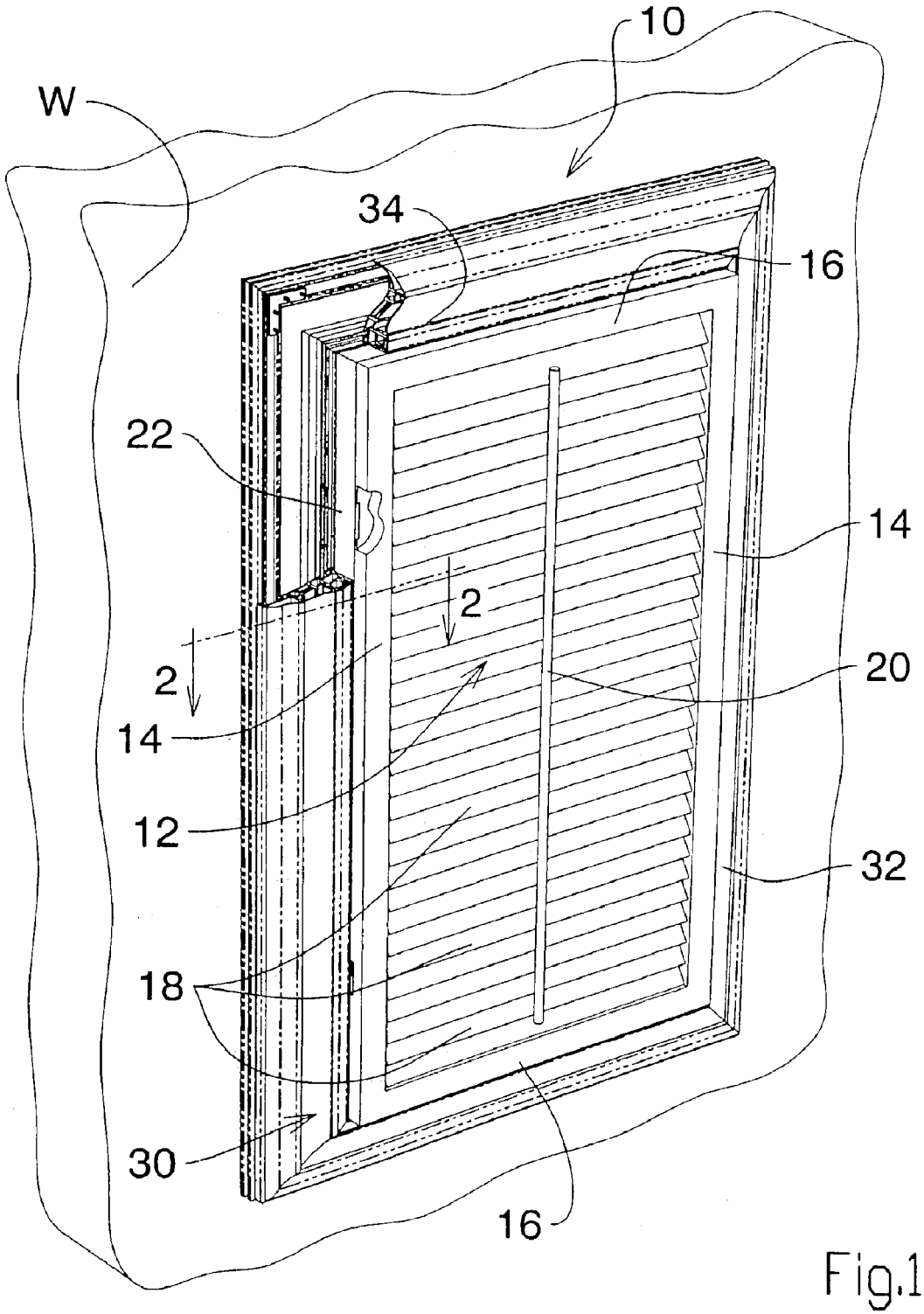
FIG. 1 is a perspective view of shutter assembly mounted in a border frame, which is partially cut away.

FIG. 1 shows the shutter (12) being comprised of a pair of vertically opposed side portions (14) and a pair of horizontally opposed side portions (16). The shutter (12) also includes a plurality of horizontal louvres (18) mounted between opposed vertical side portions (14). A louvre usually is hollow extrusion of suitable plastic as shown on FIG. 1. Each louvre (18) has a pivot pin on each end (not shown) received in the vertical side portions (14). The vertical side portions (14) include a plurality of louvre pivot pin openings (not shown). The tilt of the louvres can be adjusted by the tilt control bar (20). The tilt control bar (20) is a bar made of material such as plastic, wood or aluminum. The tilt control bar (20) is attached to the front edge of each louvre in the group via a link (not shown) in FIG. 1. The tilt control bar adjusts the tilt of all the louvres in the same group in unison.

Shutters of this general type may preferably be mounted in a decorative border frame (30) A side portion (14) is hinged to, a support frame (22).

Side Sections of Border Frame

The border frame (30) has two vertical side sections (32) and two horizontal side sections (34) that form the border frame (30). For purpose of this disclosure, that the vertical side sections (32) and the horizontal side sections (34) of the border frame (30) are similar in their construction and such sections could be interchanged.

Figure 2:
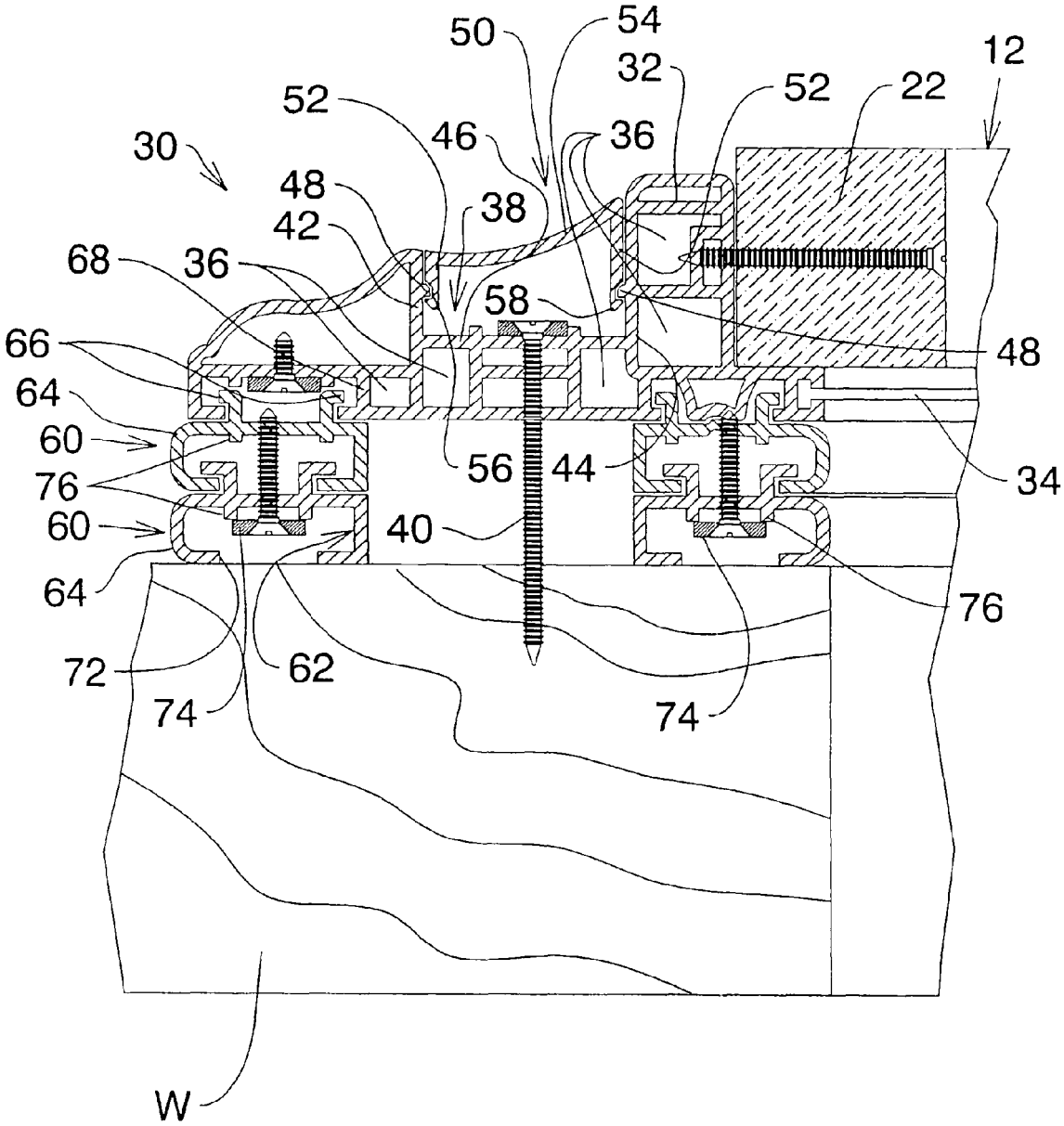
FIG. 2 is a cross-section along 2-2 of FIG. 1, of the border frame with a cover plug channel installed.
Figure 3:
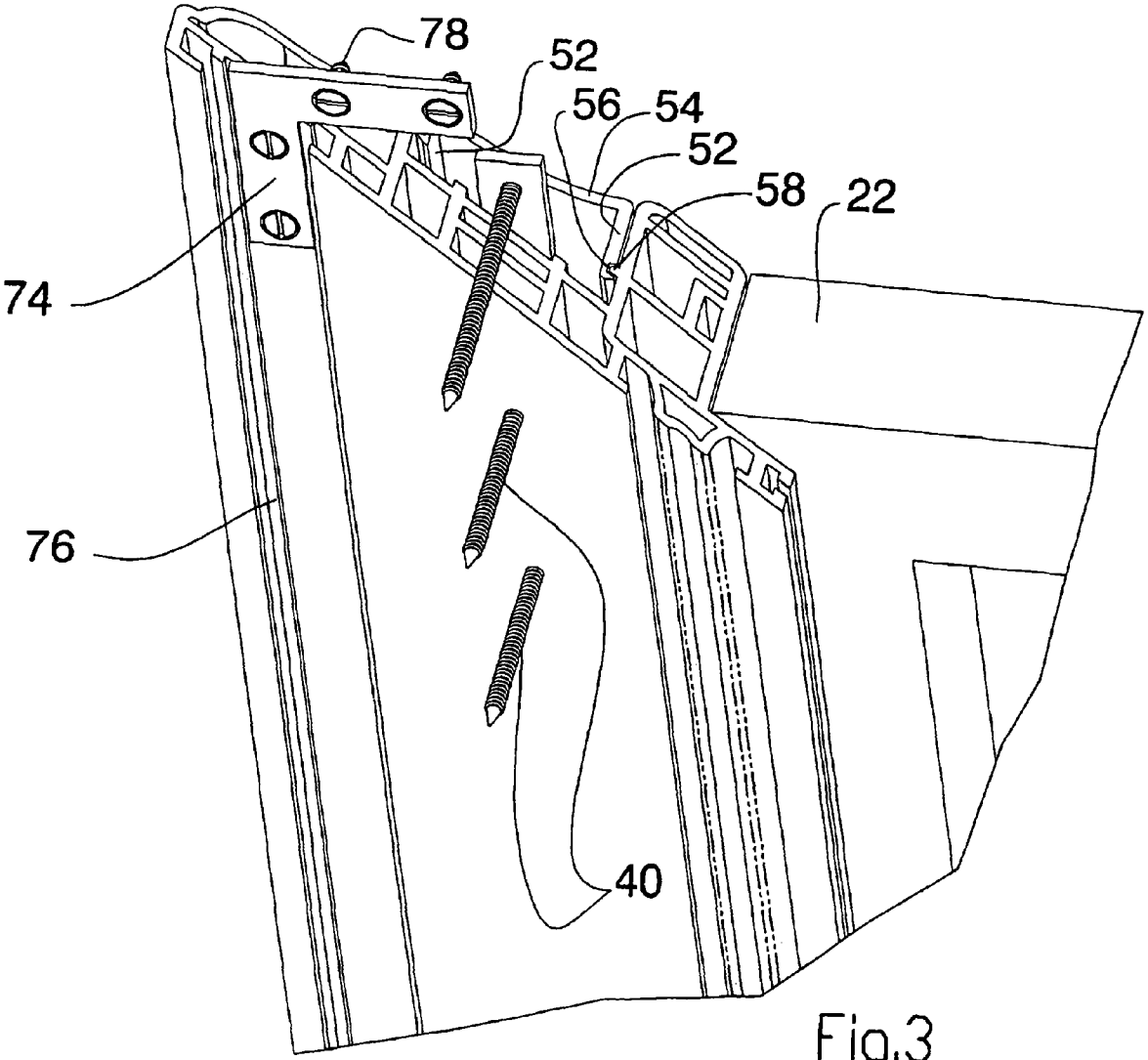
FIG. 3 is a perspective cut away view of a border frame with L-shaped reinforcement brackets installed.

The cross-section of the side sections (32-34) of the border frame (30) is shown in FIG. 2. It will be seen to comprise a plurality of walls at right angles to one another, and defining between them a series of rectangular tubes (36). This form of hollow multi tube structure provides an extrusion of great strength, while economising in material, and weight.

The border frame (30) is secured around the opening of a window or door, to complement and enhance the appearance of the shutter (12).

Fastener Channel and Cover Plug.

Each side section (32-34) of the border frame (30) has a recessed fastener channel (38) to accommodate fasteners (40), such as screws or the like, as shown on FIG. 2.

The fastener channel (38) is formed by channel walls (42) and (44) and a median or bottom wall I (46) which are spaced apart on three sides to define the channel (38). Along walls (42) there are formed first locking devices namely, locking ribs (48). The fasteners are installed in the fastener channels (38) and pass through the side sections into the building fabric surrounding and defining the window or door.

The cover plug channel (50) in this embodiment comprises a generally three side hollow extruded channel structure, having plug walls (52) and an outer web wall (54) joining the two plug walls (52)adjacent the open mouth of channel (38).

It will be appreciated that, being formed of extruded plastic, the walls (52) are somewhat flexible, and will flex towards one another. Due to the low fatigue life of plastics, this flexing might render the plug relatively easy to remove, if it were simply held in place by friction and nothing else. In fact without some special retention features it would be unlikely to stay in place for an extended time.

The web wall (54) is formed with a profile which might be planar, if desired, but in this case has a generally concave (or convex) or other curvature, or complementary profile shaping. This profile will complement the exterior appearance of the border frame itself. In order to provide for permanent retention in the fastener channel, the plug walls (52) are formed with second locking devices namely grooves (56) with generally sloping ramps (58).

When the cover plug (50) is inserted the two plug walls (52) of the cover plug channel (50) are inserted in the mouth of the fastener channel (38) and pressed down into the fastener channel (38). The ramps (58) will engage the ribs (48), and this will cause inward flexing of the plug walls (52). Once the ramps (58) pass the ribs (48), the plug walls (52) will flex out again causing the ribs (48) to seat in the grooves (56), thus holding the cover plug (50) firmly in position, with its web (54) located at the correct position relative to the border frame (30), so that it complements the profile of the border frame, appears to be a part of the border frame (30) itself.

Foot Member Extensions

It is recognised that the shape and dimensions of the border frame (30) may not accommodate all possible shapes and sizes of shutter. In particular the height of the border frame (30) may require adjustment to receive and complement a shutter of greater width.

Accordingly, there are provided elongated extruded foot members (60), which can be added to the border frame (30) and increase its depth or spacing away from the wall. Each foot member (60) comprises a generally rectangular tube (62) having an outer curved wall (64), providing an exterior moulded appearance complementing the exterior profile of the border frame (30).

Two right angular ribs (66) extend from tube (62), which are generally L-shaped in section.

The border frame (30) has two rectangular tubes (68) having open sides (70).

The ribs (66) can be fitted within the open sides (70) of tubes (68) (FIG. 2).

The foot member (60) has an open side (72) similar in shape and size to open side (70) of border frame (30). In this way two such foot members (60) can be interlocked or nested with each other (FIG. 2) to provide still greater height for the border frame (30).

At the corners where the border frame (30) portions are joined at right angles there are generally L-shaped metal plates (74) for reinforcement. The border frame sections, and also the foot members, are formed with reinforcement ribs (76) to receive and hold the plates (74).

Fastenings such as screws (78) pass through the plates (74) and into the border frame (30) sections (FIG. 2). Such reinforcement plates are also secured by screws in at least some of said extension members (FIG. 2).

The foregoing is a description of a preferred embodiment of the invention by way of example only. The invention is not to be taken as restricted to any of the specific features described but comprehends all such variations as come within the scope of the following claims.

What is claimed is:

1. A shutter assembly having a shutter and a border frame attachable to a building fabric for surrounding the shutter, said shutter having a rectangular shutter frame and louvres in said shutter frame, and comprising;

a plurality of border frame side sections each formed of extruded plastic, having a predetermined exterior profile, and assembled together at corner junctions to form said border frame;

each of said border frame side sections defining a plurality of hollow tubes, separated by thin walls;

a recessed fastener channel formed integrally in the border frame side sections for receiving fasteners for holding the border frame in place, said fastener channel defining opposed fastener channel walls;

a plastic removable cover plug channel having flexible plug walls and an outer web wall extending between said plug walls, defining a three sided hollow channel shape in section for fitting in said fastener channel and closing said fastener channel and thereby concealing fasteners, said web wall defining an exterior profile complementing said border frame side sections;

first locking devices on said fastener channel walls; and, second locking devices on said plug walls, said first and second locking devices interfitting with one another and retaining said plug channel in said fastener channel.

2. A shutter assembly having a shutter and a border frame attachable to a building fabric for surrounding the shutter as claimed in claim 1 and including at least one L-shaped reinforcement plate connected to said border frame sections at each corner junction of said frame.

3. A shutter assembly having a shutter and a border frame attachable to a building fabric for surrounding the shutter as claimed in claim 2 and including reinforcement channels having side walls for receiving said reinforcement plates.

4. A shutter assembly having a shutter and a border frame attachable to a building fabric for surrounding the shutter as claimed in claim 1 and wherein each said fastener channel is comprised of two opposed channel walls and a bottom web surface and wherein said first locking device includes a rib that extends along the axis of the channel walls from one end of the fastener channel of the other end of said fastener channel.

5. A shutter assembly having a shutter and a border frame attachable to a building fabric for surrounding the shutter as claimed in claim 4 and wherein said side sections comprise a plurality of hollow tubular sections and thin planar walls separating said sections, and pairs of spaced apart guide ribs on some said walls, and corner reinforcements between said guide ribs.

6. A shutter assembly having a shutter and a border frame attachable to a building fabric for surrounding the shutter as claimed in claim 5 and wherein said corner reinforcements are right angular sheet metal members.

7. A shutter assembly having a shutter and a border frame attachable to a building fabric for surrounding the shutter as claimed in claim 6 and wherein there are at least two said corner reinforcements for each corner of said frame.

8. A shutter assembly having a shutter and border frame attachable to a building for surrounding the shutter as claimed in claim 7 wherein one pair of said guide ribs is located in said fastener channel on said bottom web surface thereof, and a said corner reinforcement is engaged therein.

9. A shutter assembly having a shutter and a border frame attachable to a building fabric for surrounding the shutter as claimed in claim 1 and wherein said cover plug is formed of extruded plastic material and defines a three sided channel, comprising two plug walls, and a cover wall therebetween, said cover wall being contoured to complement the shape of said border frame.

10. A shutter assembly having a shutter and a border frame attachable to a building fabric for surrounding the shutter as claimed in claim 9 and wherein said plug walls of the cover plug are resilient and flexible for insertion of said cover plug into the fastener channel.

11. A shutter assembly having a shutter and a border frame attachable to a building fabric for surrounding the shutter as claimed in claim 10 and wherein each of said plug walls of the cover plug have inner and outer sides and second locking device includes a groove in said outer sides that extends along the axis of the plug wall from one end to the other.

12. A shutter assembly having a shutter and a shutter assembly having a shutter and a border frame attachable to a building fabric for surrounding the shutter as claimed in claim 11 and including a ramp surface on each outer side of each plug wall of the cover plug sloping from the outer side of the plug wall of the cover plug towards the inner side of the plug wall.

13. A shutter assembly having a shutter and a border frame attachable to a building fabric for surrounding the shutter as claimed in claim 1 and including foot sections attachable to the side sections, in order to provide a frame of greater depth.

14. A shutter assembly having a shutter and a border frame attachable to a building fabric for surrounding the shutter as claimed in claim 13 and including an open mouthed channel formed in said foot sections, and inturned lips on said channel, for engagement with another said foot section.

15. A shutter assembly having a shutter and a border frame attachable to a building fabric for surrounding the shutter as claimed in claim 14 and including two pairs of said foot sections for each said side section, each said pair comprising a first foot section engaged with said side section, and a second said foot section engaged with said first foot section.

* * * * *